US009138792B2

(12) United States Patent
Hill et al.

(10) Patent No.: US 9,138,792 B2
(45) Date of Patent: Sep. 22, 2015

(54) AUTOMATED TUBE STRAIGHTENING APPARATUS

(71) Applicant: The Boeing Company, Chicago, IL (US)

(72) Inventors: Steven P. Hill, Lebanon, OR (US); Ronald Robert Lermo, Vancouver, WA (US); Albert L. Hametner, Burien, WA (US)

(73) Assignee: The Boeing Company, Chicago, IL (US)

( * ) Notice: Subject to any disclaimer, the term of this patent is extended or adjusted under 35 U.S.C. 154(b) by 194 days.

(21) Appl. No.: 14/019,975

(22) Filed: Sep. 6, 2013

(65) Prior Publication Data

US 2015/0068008 A1 Mar. 12, 2015

(51) Int. Cl.
*B21D 3/10* (2006.01)
*B21D 3/16* (2006.01)

(52) U.S. Cl.
CPC ... *B21D 3/10* (2013.01); *B21D 3/16* (2013.01)

(58) Field of Classification Search
CPC ..... B21D 3/00; B21D 3/10; B23Q 17/22
USPC ..... 72/457, 453.01, 16.2–16.4, 17.3–18.2, 72/31.03, 31.04
See application file for complete search history.

(56) References Cited

U.S. PATENT DOCUMENTS

| | | | | |
|---|---|---|---|---|
| 3,583,191 | A * | 6/1971 | Colonius et al. | 72/110 |
| 4,144,730 | A * | 3/1979 | Judge, Jr. | 72/18.1 |
| 4,947,666 | A | 8/1990 | Hametner et al. | |
| 5,046,852 | A * | 9/1991 | Hametner et al. | 356/398 |
| 5,309,746 | A * | 5/1994 | Abbey, III | 72/8.3 |
| 5,390,520 | A * | 2/1995 | Hermes et al. | 72/16.2 |
| 6,354,126 | B1 | 3/2002 | Small et al. | |
| 6,901,833 | B2 | 6/2005 | Jorgenson et al. | |
| 7,654,122 | B2 | 2/2010 | Tsuyuguchi et al. | |
| 8,230,709 | B2 * | 7/2012 | Daube et al. | 72/9.1 |
| 2005/0262911 | A1 * | 12/2005 | Dankowicz et al. | 72/31.04 |
| 2007/0017271 | A1 * | 1/2007 | Anagnostopoulos | 72/307 |
| 2008/0257949 | A1 * | 10/2008 | Hills et al. | 235/375 |
| 2009/0171501 | A1 * | 7/2009 | Hills | 700/230 |
| 2010/0215144 | A1 * | 8/2010 | Basu et al. | 378/20 |
| 2011/0142195 | A1 * | 6/2011 | Hills et al. | 378/19 |
| 2013/0160514 | A1 * | 6/2013 | Mitze | 72/224 |

FOREIGN PATENT DOCUMENTS

| | | | |
|---|---|---|---|
| CN | 101712053 | * | 5/2010 |
| DE | 40 22 951 | | 1/1992 |
| DE | 20 2010 011 976 | | 12/2011 |
| JP | 2004322185 | | 11/2004 |

OTHER PUBLICATIONS

Search Report dated Jan. 22, 2015 in co-pending European Patent Application No. 14172085.4-1702.

* cited by examiner

*Primary Examiner* — David Bryant
*Assistant Examiner* — Lawrence Averick
(74) *Attorney, Agent, or Firm* — Joseph M. Rolnicki; Evans & Dixon, L.L.C.

(57) ABSTRACT

A shaft straightening or tube straightening apparatus performs accurate measurements of the linear profile of a metal tube, and then corrects small and large deviations of the tube profile from the ideal centerline along the length of the tube. The tube straightening apparatus is operable to accurately measure a linear profile of the tube positioned in the apparatus. The tube is rotated in the apparatus to locate a pair of low points in the tube profile and a high point of the tube between the two low points. The tube is supported in the apparatus at the pair of low points and the high point of the tube is then deflected beyond the yield point of the metal of the tube to permanently distort the tube and correct the tube's profile.

19 Claims, 7 Drawing Sheets

AUTOMATED TUBE STRAIGHTENING APPARATUS

FIELD

This disclosure pertains to a shaft straightening or tube straightening apparatus that performs accurate measurements of the linear profile of a metal tube, and then corrects small and large deviations of the tube profile from the ideal centerline along the length of the tube. More specifically, the present disclosure pertains to an automated tube straightening apparatus that is operable to accurately measure a linear profile of a metal tube positioned in the apparatus. The tube is rotated in the apparatus to locate a pair of low points in the tube profile and a high point of the tube profile. The tube is supported in the apparatus at the pair of low points and the high point of the tube is then deflected beyond the yield point of the metal of the tube to permanently distort the tube and correct the tube's profile.

BACKGROUND

Aluminum and stainless steel shafts and/or tubes ranging from 1-3½ inches in diameter, and 29-169 inches in length, are often heat treated which typically warps the tube in one or more planes. Deformation of the tubes can range in form from a simple bow along the tube length, to a complex spiral of the tube length. The span of a deformation can range from 4 inches of the overall tube length, to the entire length of the tube. Multiple deformations can occur in each tube.

Corrections to the tube deformations or "run out" are currently made manually with a dial indicator, a hand press, and two supporting fixtures for the tube which are moved along the tube length as needed. Corrections are made by profiling the tube length and determining where corrections are needed, and then strategically positioning the tube on the supporting fixtures where the ram of the hand press can be used to deflect the tube to decrease the tube run out and straighten the tube profile. The operator of the hand press positions the ram of the press at the tube high point and then extends the ram a distance to deflect the tube and correct the measured run out of the tube high point by anticipating the spring back of the tube after the force of the ram is removed. An acceptable run out is 5/1000 of an inch over the entire length of the tube. This manual process of correcting tube deformations is labor intensive and requires experienced operators to straighten tubes. This process is a major bottleneck in the aerospace industry manufacturing tubes used for drive shafts and actuator rods.

SUMMARY

The shaft or tube straightening apparatus of the invention provides an operator controlled or fully automated system that simulates the manual tube straightening operation.

The apparatus comprises a frame that supports the apparatus in an upright orientation. The frame has a centrally located open area that is dimensioned to receive a length of shaft or tubing to be straightened by the apparatus.

A plurality of holding cylinders or holding devices are supported on the frame. The holding devices are arranged side-by-side on the frame beneath the frame open area. Each of the holding devices has a rod with an end surface that is configured as a holding fixture for holding a portion of a tube engaged by the end surface. Each of the rods is movable in reciprocating movements along an axis of the rod between an extended position of the rod from the holding device, and a retracted position of the rod relative to the holding device. In the rod extended position the rod end surface is moved into the frame open area to engage with a tube that has been positioned in the open area and to support the tube on the rod end surface.

The apparatus also comprises a plurality of actuator ram cylinders or actuator devices that are supported on the frame. The actuator devices are positioned side by side on the frame on an opposite side of the frame open area from the plurality of holding devices. Each of the actuator devices has a ram that is movable in reciprocating movements along an axis of the ram between an extended position of the ram from the actuator device, and a retracted position of the ram relative to the actuator device. Each ram has an end surface configured for engaging and exerting a force against an area of the tube positioned in the frame open area. In the extended position of the ram, the ram end surface is moved into the frame open area to engage with a tube that is supported on at least two of the end surfaces of holding device rods that have been extended into the open area. The extended ram end surface engaging with the tube supported in the frame open area bends the tube. As the ram end surface bends the tube it moves the portion of the tube being bent a distance through the frame open area.

A plurality of proximity sensors are also supported on the frame. The proximity sensors are positioned side by side adjacent the plurality of actuator devices on the opposite side of the frame open area from the plurality of holding devices. Each of the proximity sensors is operable to sense the distance the tube is moved through the frame open area as the tube is being bent by the actuator device ram engaging the tube.

The apparatus also includes a rotation device supported on the frame. The rotation device is positioned adjacent the frame open area and between the plurality of holding devices and the plurality of actuator devices. The rotation device is connectable to the tube positioned in the frame open area and is operable to rotate the tube in the open area.

The apparatus also includes a controller that communicates with the plurality of holding devices, the plurality of actuator devices, the plurality of proximity sensors and the rotation device. The controller includes an operator screen or display screen communicating with the controller. The display screen is operable to display a visual indication of the distance sensed by each of the proximity sensors to the portion of the tube in the frame open area that is opposite the proximity sensor.

In operation of the apparatus, a length of tube to be straightened by the apparatus is first positioned in the frame open area. The rods of the plurality of holding devices are then extended to precision hard stops of the holding devices that control the extended positions of the rod. The length of tube is supported on the rod end surfaces. The rotation device is connected to an end of the tube to hold the tube against rotation in the frame open area. The plurality of proximity sensors are activated to float on the surface of the tube opposing the proximity sensors. Each of the proximity sensors senses its distance from the tube surface, and the tube profile in one plane is measured from data signals provided by the proximity sensors to the controller. The proximity sensor data is displayed on the display screen. From the displayed data the tube is rotated until the maximum error in the tube's profile is detected. The best supporting holding devices are identified for supporting the tube at two low points of the tube profile for the desired correction of the tube profile. All of the other holding device rods between the selected two supporting rods are retracted to allow for deflection of the tube between the two supporting rods.

The display of the sensor data on the displays screen also identifies a high point in the tube profile. The ram of the actuator device at the high point is then extended from the actuator device to engage against the profile high point of the tube. The engagement of the ram end surface against the tube high point begins to bend the tube and move the tube a distance through the frame open area. The distance the tube is moved through the frame open area as the ram end surface bends the tube is sensed by the proximity sensor associated with the actuator device of the extended ram. The extension of the ram from the actuator device is controlled to bend the portion of the tube at the tube high point and move the portion of the tube a specified distance through the frame open area based on the run out of the tube profile. The bending of the tube is tracked by the controller from the proximity sensor data. When the desired deflection distance of the tube is achieved, the actuator device ram is retracted. The resulting tube profile is evaluated by the plurality of proximity sensors and the controller and the profile correction process is applied again if needed. Once a desired correction of the tube profile is achieved, the rotation device is activated to rotate the tube in the frame open area to identify the next deformation of the tube that is to be corrected using the same procedure. The process is repeated until the run out of the tube is within acceptable specifications.

Further features of the apparatus and associated method are set forth in the following detailed description of the apparatus and in the drawing figures.

DESCRIPTION

Figure 1:
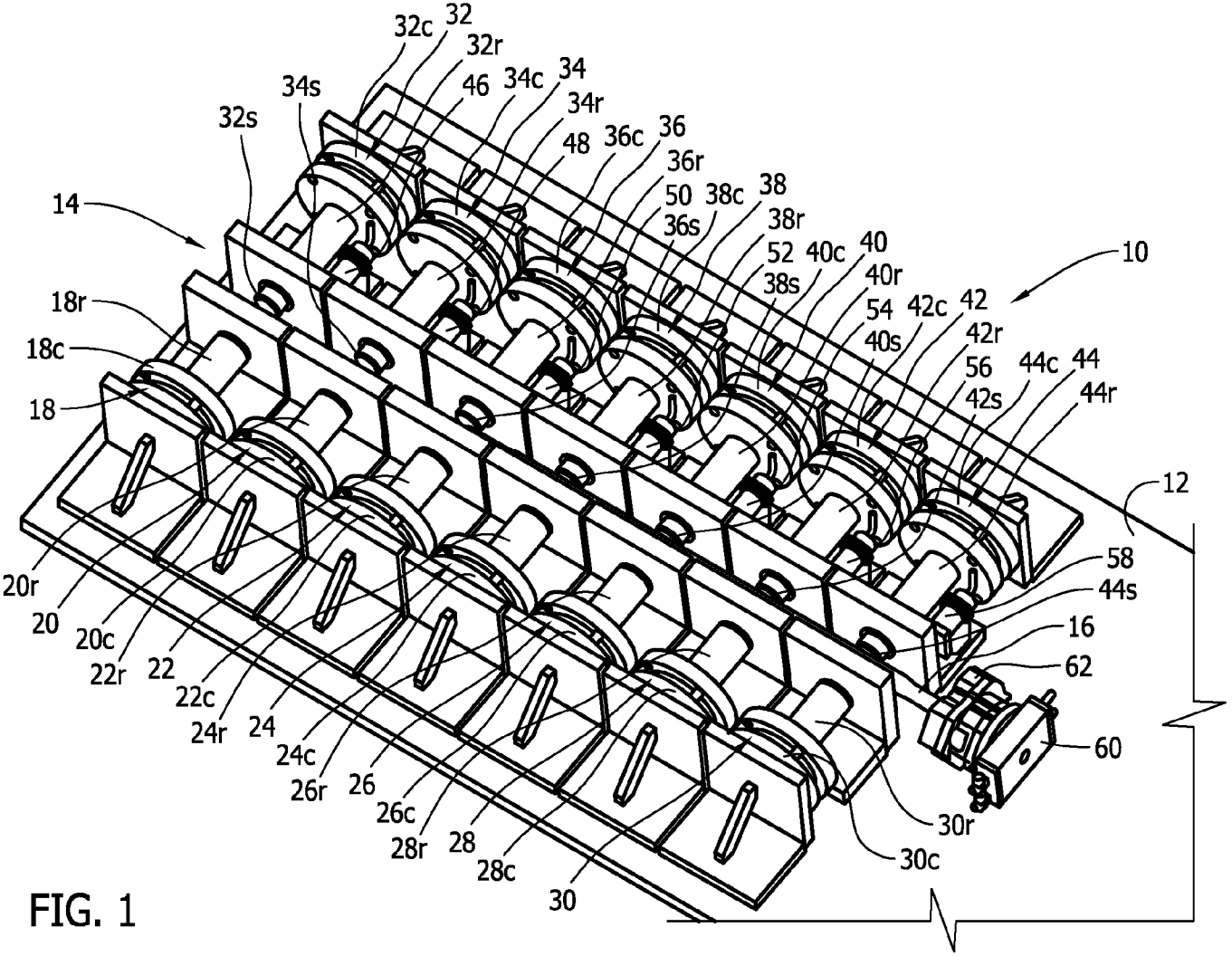
FIG. 1 is a representation of a perspective view of a tube straightening apparatus.

FIG. 1 is a representation of a perspective view of an automated tube straightening apparatus 10. As will be explained, the apparatus 10 provides an operator controlled or fully automated system that simulates the manual tube straightening operation.

The apparatus 10 comprises a frame 12 that supports the apparatus in a generally upright orientation. The frame 12 shown in FIG. 1 is represented as a flat, generally rectangular panel. However, the frame 12 could be any structure that securely supports the component parts of the apparatus 10 in their relative positions to be described. The frame 12 has a centrally located open area 14 with the component parts of the apparatus to be described being positioned on opposite sides of this open area. The open area 14 is dimensioned to receive a length of shaft or tube 16 that is to be straightened by the apparatus. Although the apparatus 10 and its method of operation to be described refer to the apparatus straightening the length of tube 16, it should be understood that the concepts of the apparatus 10 can be employed in straightening the length of other similar structural features such as shafts, rods, etc.

A plurality of holding devices 18, 20, 22, 24, 26, 28, 30 are supported on the frame 12. In the exemplary embodiment of the apparatus 10 shown in FIG. 1, the holding devices 18, 20, 22, 24, 26, 28, 30 are each comprised of a holding cylinder 18*c*, 20*c*, 22*c*, 24*c*, 26*c*, 28*c*, 30*c* and a rod 18*r*, 20*r*, 22*r*, 24*r*, 26*r*, 28*r*, 30*r* that projects from its respective cylinder. In other embodiments of the apparatus the holding devices could be other equivalent types of linear actuators, including pneumatic cylinders, hydraulic cylinders, and motor and screw actuators. Each of the rods is movable in reciprocating movements along an axis of the rod between an extended position of the rod from the holding device, and a retracted position of the rod relative to the holding device.

As represented in FIG. 1, the holding devices 18, 20, 22, 24, 26, 28, 30 are arranged side-by-side on the frame 12 beneath the frame open area 14. The rods 18*r*, 20*r*, 22*r*, 24*r*, 26*r*, 28*r*, 30*r* are positioned with their axes parallel. Each of the rods 18*r*, 20*r*, 22*r*, 24*r*, 26*r*, 28*r*, 30*r* has a respective end surface 18*s*, 20*s*, 22*s*, 24*s*, 26*s*, 28*s*, 30*s* on a distal end of the rod from its respective holding cylinder. The rod end surfaces 18*s*, 20*s*, 22*s*, 24*s*, 26*s*, 28*s*, 30*s* are all positioned in substantially a same plane with the rods in their retracted positions relative to their respective cylinders, and are all positioned below the frame open area 14. Inside its associated holding cylinder, each of the rods 18*r*, 20*r*, 22*r*, 24*r*, 26*r*, 28*r*, 30*r* is provided with a precision hard stop that limits the extension of the rod from its associated cylinder. With each of the rods extended to their precision hard stop, the rod end surfaces 18*s*, 20*s*, 22*s*, 24*s*, 26*s*, 28*s*, 30*s* are all positioned in substantially a same plane and are all positioned in the frame open area 14. Each of the rod end surfaces 18*s*, 20*s*, 22*s*, 24*s*, 26*s*, 28*s*, 30*s* is configured as a holding fixture for holding a portion of the tube 16 engaged by the rod end surface. In the rod extended positions, the rod end surfaces 18*s*, 20*s*, 22*s*, 24*s*, 26*s*, 28*s*, 30*s* are moved into the frame open area 14 to engage with a tube 16 that has been positioned in the open area and to support the tube on at least two of the rod end surfaces.

The apparatus 10 also comprises a plurality of actuator devices 32, 34, 36, 38, 40, 42, 44 that are supported on the frame 12. In the exemplary embodiment of the apparatus 10 represented in FIG. 1, each of the actuator devices 32, 34, 36, 38, 40, 42, 44 is comprised of an actuator cylinder 32*c*, 34*c*, 36*c*, 38*c*, 40*c*, 42*c*, 44*c* and a ram 32*r*, 34*r*, 36*r*, 38*r*, 40*r*, 42*r*, 44*r* that projects from its respective cylinder. Each of the rams is movable in reciprocating movements along an axis of the ram between an extended position of the ram from the actuator device, and a retracted position of the ram relative to the actuator device. The reciprocation axes of the rams 32*r*, 34*r*, 36*r*, 38*r*, 40*r*, 42*r*, 44*r* are all parallel to each other and are coaxial with the respective reciprocation axes of the holding device rods 18*r*, 20*r*, 22*r*, 24*r* 26*r*, 28*r*, 30*r*. The actuator devices 32, 34, 36, 38, 40, 42, 44 are positioned side by side on the frame 12 on the opposite side of the frame open area 14 from the respective holding devices 18, 20, 22, 24, 26, 28, 30.

In the exemplary embodiment represented in FIG. 1, the closeness of adjacent rams 32*r*, 34*r*, 36*r*, 38*r*, 40*r*, 42*r*, 44*r* is limited by the diameter dimensions of their respective actuator cylinders. For example, if each of the actuator cylinders 32*c*, 34*c*, 36*c*, 38*c*, 40*c*, 42*c*, 44*c* has a 4 inch diameter dimension, then the closest adjacent rods 32*r*, 34*r*, 36*r*, 38*r*, 40*r*, 42*r*, 44*r* could be to each other is 4 inches. However, in a variant embodiment of the apparatus represented in FIG. 2, by staggering the positions of the actuator cylinders 32*c*, 34*c*, 36*c*, 38*c*, 40*c*, 42*c*, 44*c* and providing every other actuator device with a ram having a different axial length, the distances between adjacent rams 32*r*, 34*r*, 36*r*, 38*r*, 40*r*, 42*r*, 44*r* can be reduced to substantially half of that in the embodiment of the apparatus represented in FIG. 1.

Referring back to FIG. 1, each of the rams 32*r*, 34*r*, 36*r*, 38*r*, 40*r*, 42*r*, 44*r* has a respective end surface 32*s*, 34*s*, 36*s*, 38*s*, 40*s*, 42*s*, 44*s* on a distal end of the ram from its respective actuator cylinder. In the retracted positions of the rams, the ram end surfaces 32*s*, 34*s*, 36*s*, 38*s*, 40*s*, 42*s*, 44*s* are positioned in substantially a same plane above the frame open area 14. Each ram end surface 32*s*, 34*s*, 36*s*, 38*s*, 40*s*, 42*s*, 44*s* is configured for engaging and exerting a force against an area of the tube 16 positioned in the frame open area 14. In the extended position of the rams, the ram end surfaces 32*s*, 34*s*, 36*s*, 38*s*, 40*s*, 42*s*, 44*s* are moved into the frame open area 14 to engage with the tube 16 that is supported on at least two of the holding device rod end surfaces 18*s*, 20*s*, 22*s*, 24*s*, 26*s*, 28*s*, 30*s* that have been extended into the open area 14. Each ram end surface can be selectively moved into the frame open area 14 to engage with the tube supported in the frame open area and bend the tube. As the ram end surface bends the tube it moves the portion of the tube being bent a distance through the frame open area 14.

Figure 2:
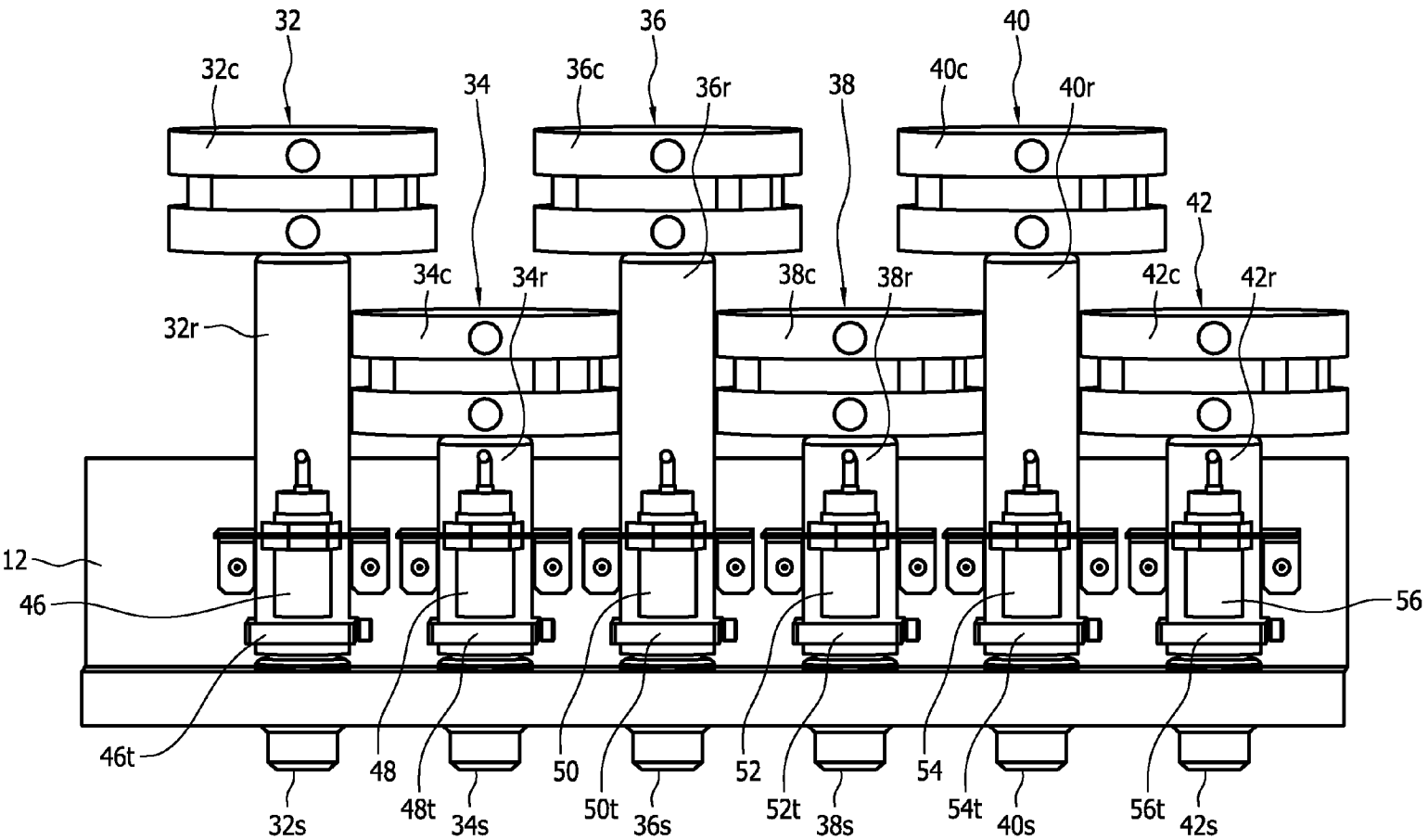
FIG. 2 is a representation of an elevation view of a portion of a variant embodiment of the apparatus shown in FIG. 1.

A plurality of proximity sensors 46, 48, 50, 52, 54, 56, 58 are also supported on the frame 12. The proximity sensors are capable of precise, accurate measurements, for example, to about 0.0001 inches. For example, the proximity sensors could be inductive proximity sensors or other equivalent types of sensors. The proximity sensors 46, 48, 50, 52, 54, 56, 58 are positioned adjacent the respective actuator devices 32, 34, 36, 38, 40, 42, 44 and on opposite sides of the frame open area 14 from the respective holding devices 18, 20, 22, 24, 26, 28, 30. As represented in FIG. 2, each of the proximity sensors 46, 48, 50, 52, 54, 56 is directed at a respective target 46*t*, 48*t*, 50*t*, 52*t*, 54*t*, 56*t* that follows the position of the tube and is operable to sense the distance a portion of the tube 16 in the frame open area 14 is from the proximity sensor. Each of the proximity sensors 46, 48, 50, 52, 54, 56, 58 can thereby sense the distance the portion of the tube 16 opposite the sensor is moved through the frame open area 14 as the tube is being bent by the adjacent actuator device ram 32*r*, 34*r*, 36*r*, 38*r*, 40*r*, 42*r*, 44*r* when the adjacent ram engages with and bends a portion of the tube.

The apparatus 10 also includes a rotation device 60 supported on the frame 12. As represented in FIG. 1, the rotation device 60 is positioned on the frame 12 adjacent the frame open area 14 and between the plurality of holding devices 18, 20, 22, 24, 26, 28, 30 and the plurality of actuator devices 32, 34, 36, 38, 40, 42, 44. The rotation device 60 includes a clamp 62 that is selectively connectable to an end of the tube 16 positioned in the frame open area 14. When connected to the tube 16, the rotation device 60 is operable to rotate the tube 16 in the frame open area 14.

The apparatus also includes a programmable logic controller 66 that communicates with the plurality of holding devices 18, 20, 22, 24, 26, 28, 30, the plurality of actuator devices 32, 34, 36, 38, 40, 42, 44, the plurality of proximity sensors 46, 48, 50, 52, 54, 56, 58 and the rotation device 60. The controller 66 includes an operator screen or display screen 68 communicating with the controller. The display screen 68 is operable to display a visual indication of the distance sensed by each of the proximity sensors 46, 48, 50, 52, 54, 56, 58 to the portion of the tube 16 in the frame open area 14 that is opposite the proximity sensor. This enables the display screen 68 to provide a visual indication of the profile of the tube 16 in the particular orientation of the tube held by the rotation device 60 in the frame open area 14. The location of the tube's upper surface or the surface directed toward the proximity sensors is displayed, providing a visual indication of the location of the tube's upper surface above the ideal zero reference. The controller 66 also includes a pair of joysticks 72, 74 on opposite sides of the controller. One of the joysticks 72, the left joystick shown in FIG. 3 has a thumb wheel 76 on the distal end of the joystick and the other joystick, the right joystick 74 shown in FIG. 3 has a trigger 78 on the distal end of the joystick. In manual mode of the apparatus 10, using the left joystick 72, the operator can translate or rotate the tube 16 until a pair of desired supporting low point portions of the tube and a desired deflection high point portion of the tube are displayed on the display screen 68.

In operation of the apparatus 10, the length of tube 16 to be straightened by the apparatus is first positioned in the frame open area 14. One end of the tube 16 is firmly grasped by the clamp 62 of the rotation device 60. The holding device rods 18*r*, 20*r*, 22*r*, 24*r*, 26*r*, 28*r*, 30*r* are then extended by an operator operating the program logic controller 66. The rods are extended to the precision hard stops of the holding devices 18, 20, 22, 24, 26, 28, 30. These position the rod distal end surfaces 18*s*, 20*s*, 22*s*, 24*s*, 26*s*, 28*s*, 30*s* in substantially a same plane. The length of tube 16 is supported on at least some of the end surfaces of the rods due to its warped profile.

The operator at the operator's screen 68 then activates the rotation device 60 to rotate the tube 16 in the frame open area 14. As the tube 16 is rotated by the rotation device 60, each of the proximity sensors 46, 48, 50, 52, 54, 56, 58 senses the distance of the portion of the tube surface opposite the sensor and produces a signal that is representative of this distance. These signals are transmitted to the programmable logic controller which then controls the display screen 68 to display a visual representation of the distance of each proximity sensor to the portion of the tube surface opposite the sensor. The operator, using the left joystick 72 of the controller 66 controls a translation of the tube 16 and rotation of the tube in the frame open area 14 until a desired warped profile of the tube surface opposite the proximity sensors is displayed on the display screen 68.

Figure 3:
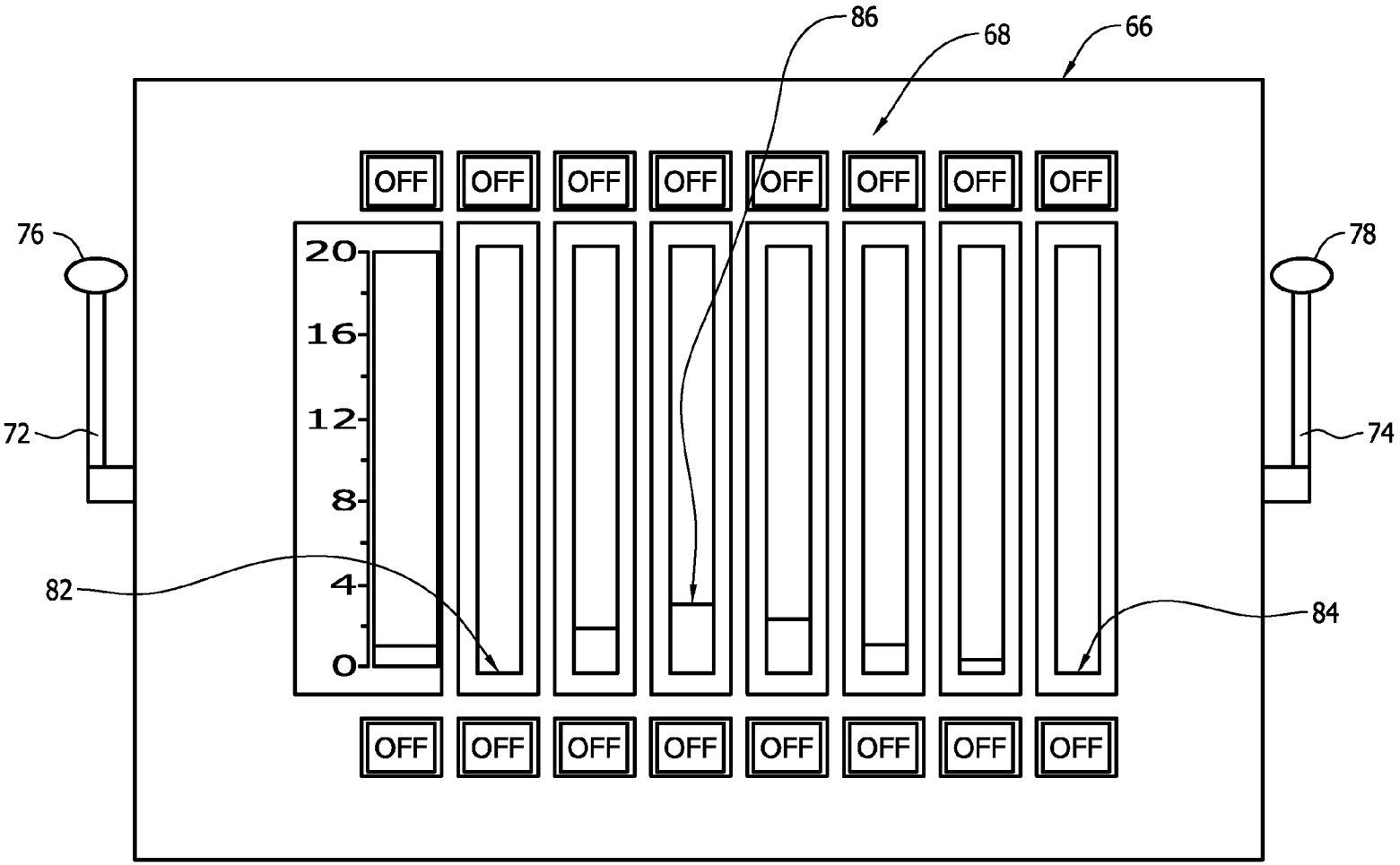
FIG. 3 is a representation of a display screen of the apparatus.
Figure 4:
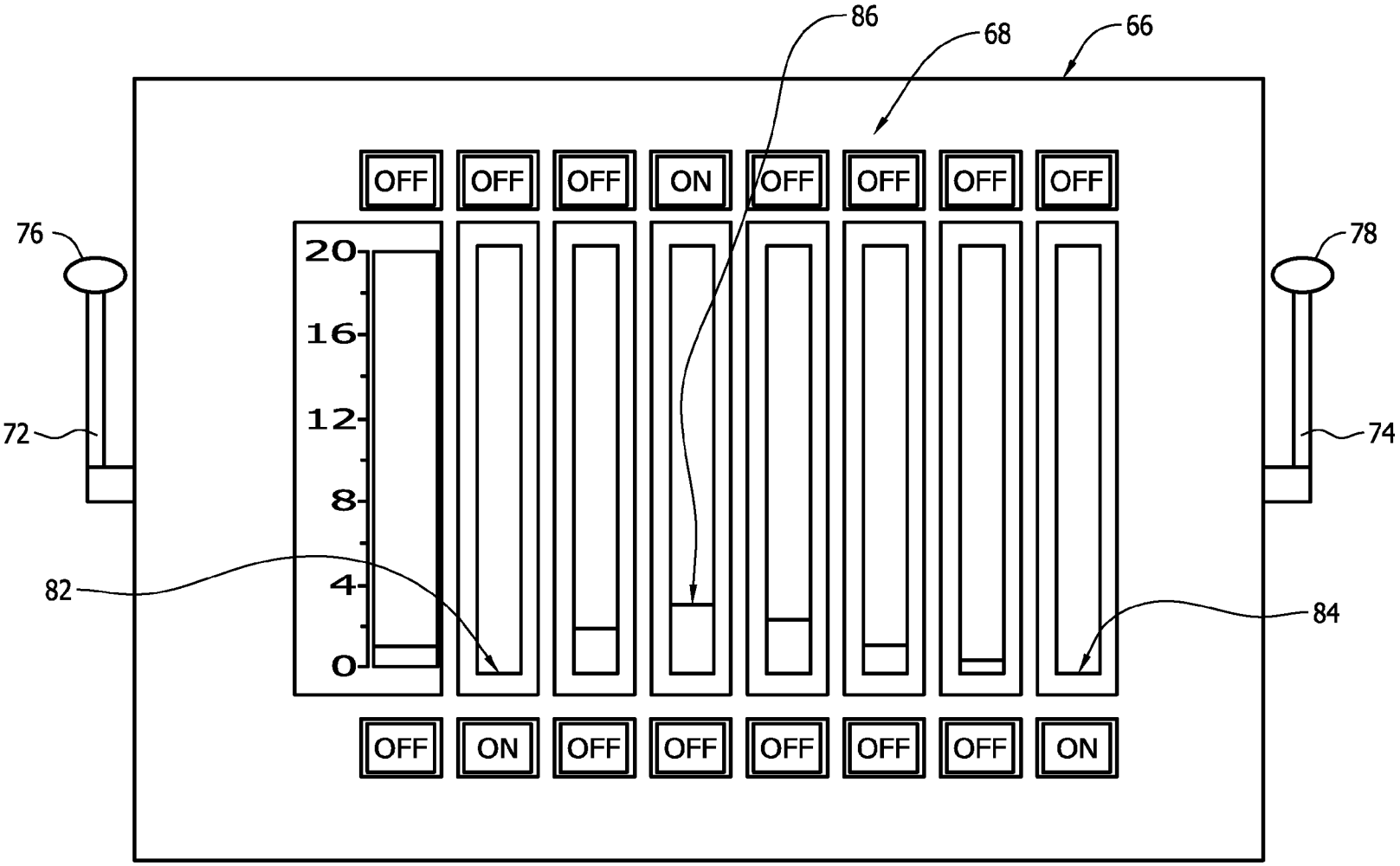
FIG. 4 is a representation of the display screen similar to that of FIG. 3, but illustrating a step in the method of operating the apparatus.

FIG. 3 is a representation of the profile of the tube 16 displayed on the display screen 68. Referring to FIG. 3, the display screen 68 displays sensed distance representations 82, 84 from the proximity sensors 46, 58 that are opposite the respective holding devices 18, 30 that are positioned at the two tube low points. By moving the right joystick 74 left and right, these holding devices 18, 30 are selected by the operator at the screen 68 to support the tube 16. This is represented in FIG. 4. The rods 20*r*, 22*r*, 24*r*, 26*r* 28*r* of the remaining respective holding devices 20, 22, 24, 26, 28 are retracted. This provides clearance between the two supporting holding devices 18, 30 for deflection of the tube 16.

Figure 5:
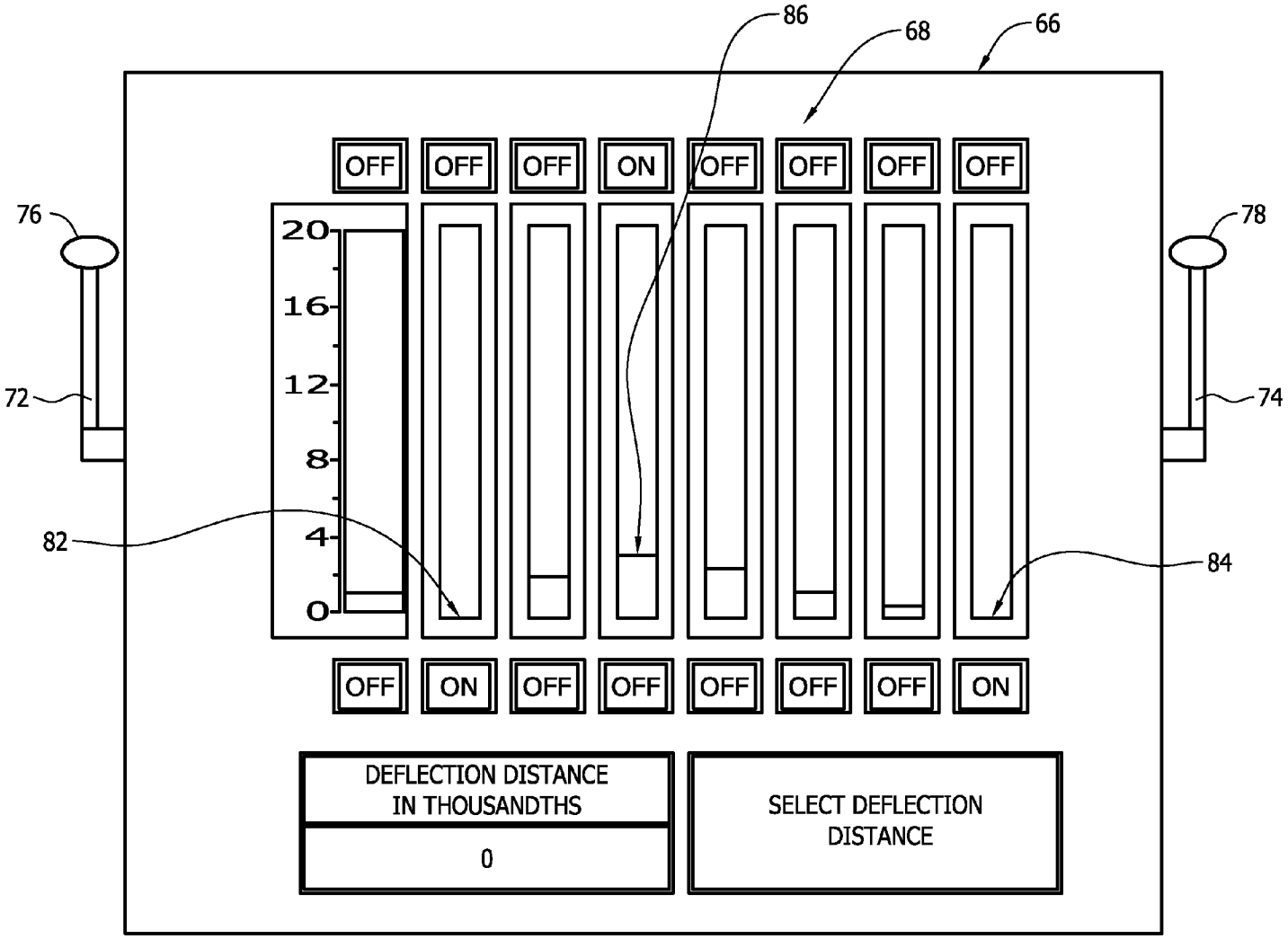
FIG. 5 is a representation of the display screen illustrating a further step in the method of operating the apparatus.
Figure 6:
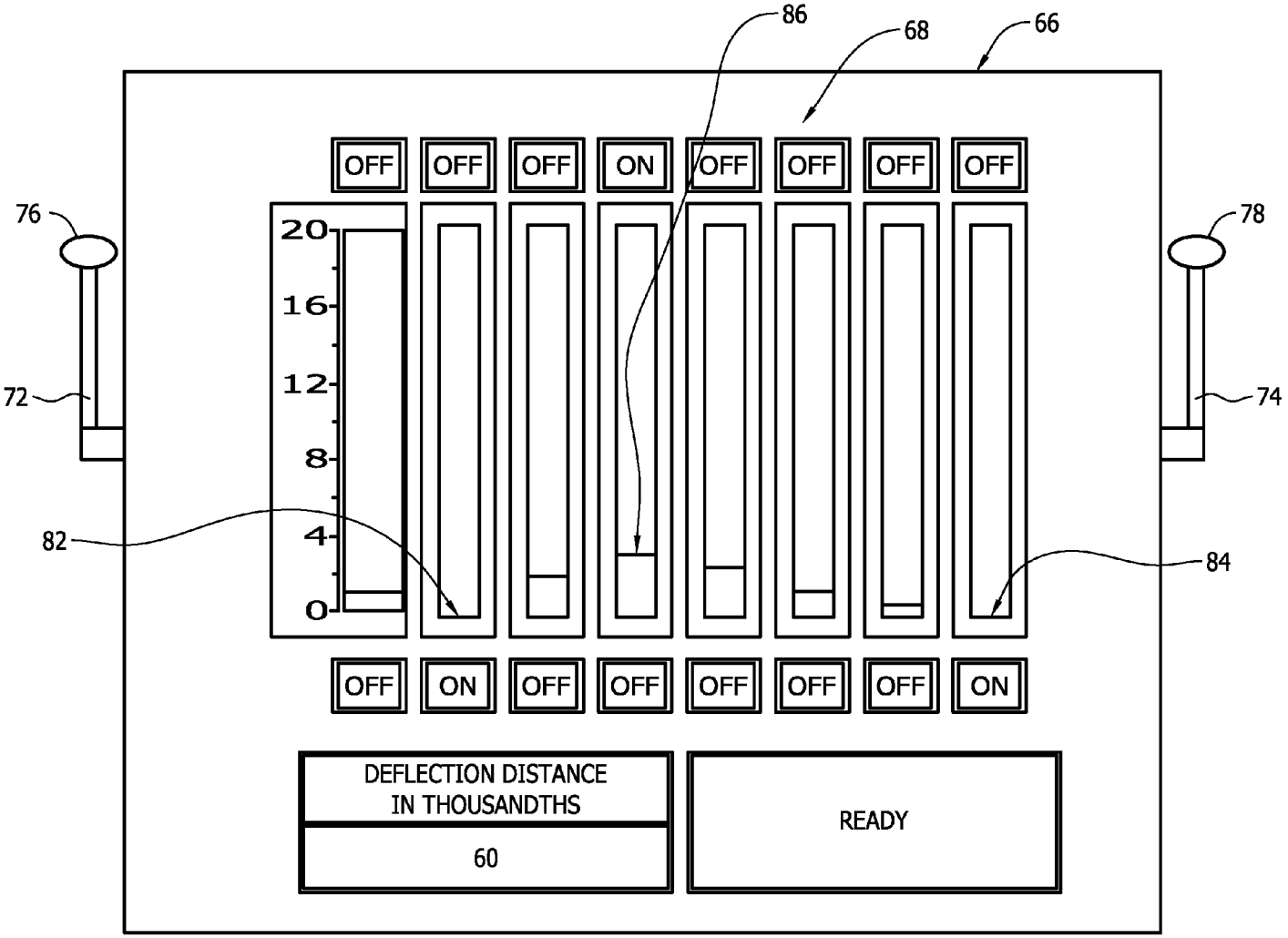
FIG. 6 is a representation of the display screen similar to that of FIG. 5, but illustrating a further step in the method of operating the apparatus.
Figure 7:
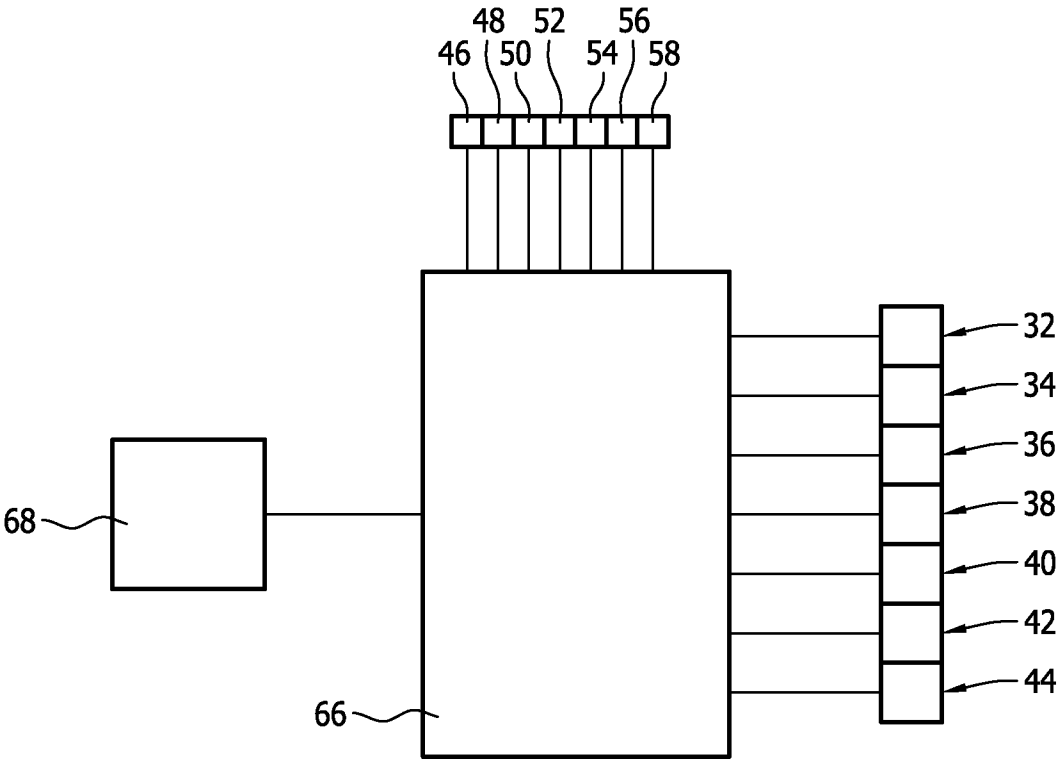
FIG. 7 is a representation of a control logical block diagram for the apparatus.

The display screen also displays a sensed distance representation 86 from the proximity sensor 50 that is opposite the high point of the tube profile. Using the right joystick 74, the operator at the screen 68 then selects the actuator device 36 that is opposite the highest portion of the tube profile sensed by the proximity sensor 50. This is represented in FIG. 4. In a manual mode of operation, the controller 66 and display screen 68 then prompt the operator to select a deflection distance using the right thumb wheel 76 as represented in FIG. 5. When operating the apparatus manually the operator guesses how much deflection is required to bend the tube beyond the yield point so that it will spring back to the desired state and enters the desired deflection value. This requires multiple corrections with each part being straightened through trial and error. However, during normal operations, the programmable controller performs mathematical calculations based on the tube's wall thickness, diameter, Young's Modulus for the material being used, the span between the two supporting dies, the second moment of inertia for the bend, the measured error value, the geometry of the stress-strain curve, and a number of approximations. From this the required deflection is calculated. The selected distance is represented in FIG. 6. The ram 36*r* of the selected actuator device 36 is then extended at a controlled rate until the ram end surface 36*s* comes into contact with the portion of the tube surface opposite the selected actuator device 36. The actuator ram 36*r* is then continued to move a desired distance that is either selected by the operator or calculated by the programmable logic controller 66 to deflect the tube 16 or bend the tube through the frame open area 14. The deflection of the tube is tracked dynamically by the programmable logic controller 66 from the signals received from the proximity sensors 46, 48, 50, 52, 54, 56, 58. When the designated deflection distance of the tube 16 is achieved, the selected actuator device 36 is then deactivated.

The resulting profile of the tube 16 is then evaluated from the data received by the programmable logic controller 66 from the proximity sensors 46, 48, 50, 52, 54, 56, 58 and the correction process is applied again if needed. Once the desired correction in the tube profile is achieved, the programmable logic controller 66 is operated by the operator to again activate the rotation device 60 to rotate the tube 16 in the frame open area 14 until the next deformation of the tube 16 is identified and corrected using the same procedure. This process is repeated until the run out of the tube 16 is within specifications.

Although the apparatus described herein and its method of use have been described by reference to a particular embodiment of the apparatus, it should be understood that modifications and variations to the apparatus and method could be made without departing from the intended scope of the claims appended hereto.

The invention claimed is:

1. A shaft straightening apparatus comprising:

a frame, the frame having an open area dimensioned to receive a shaft in the open area;

two holding devices on the frame adjacent the open area, each holding device having a rod that is extendible from the holding device and retractable to the holding device, the rod being extendible from the holding device into the open area to engage against a shaft that has been positioned in the open area and support the shaft where engaged by the rod;

a proximity sensor on the frame adjacent the open area, the proximity sensor being operable to sense a distance from the proximity sensor to a shaft that has been positioned in the open area and is supported by the holding device rods of the two holding devices, and to output a signal that is indicative of the sensed distance;

an actuator device on the frame at an opposite side of the open area from the two holding devices, the actuator device having a ram that is extendible from the actuator device and retractable to the actuator device, the ram being extendible from the actuator device into the open area to engage against a shaft that has been positioned in the open area and is supported by the holding device rods of the two holding devices, and to bend the shaft while moving the shaft a distance through the open area while the proximity sensor senses the distance the shaft is moved through the open area by the ram.

2. The apparatus of claim 1, further comprising:

the two holding devices being positioned on the frame on the opposite side of the open area from the actuator device; and, the actuator device being positioned on the frame between the two holding devices.

3. The apparatus of claim 1, further comprising:

the proximity sensor being positioned on the frame adjacent the actuator device and on the opposite side of the open area from the two holding devices.

4. The apparatus of claim 1, further comprising:

a rotation device on the frame adjacent the open area, the rotation device being operable to rotate a shaft that has been positioned in the open area.

5. The apparatus of claim 1, further comprising:

each holding device having a cylinder and the rod being extendible from the cylinder and retractable into the cylinder.

6. The apparatus of claim 1, further comprising:

the actuator device having a cylinder and the ram being extendible from the cylinder and retractable into the cylinder.

7. The apparatus of claim 1, further comprising:

a controller operable to communicate with the proximity sensor to receive the signal output by the proximity sensor; and, a display screen communicatively coupled to the controller, the display screen being operable to display a visual indication of the distance sensed by the proximity sensor.

8. The apparatus of claim 1, further comprising:

the two holding devices being two of a plurality that is more than two of like holding devices on the frame that are positioned side by side on a first side of the open area; and, the actuator device being one of a plurality of like actuator devices on the frame that are positioned side by side on a second side of the open area that is opposite the first side of the open area.

9. The apparatus of claim 8, further comprising:

the proximity sensor being one of a plurality of like proximity sensors on the frame that are positioned side by side on the second side of the open area.

10. A shaft straightening apparatus comprising:

a frame, the frame having an open area dimensioned to receive a shaft in the open area;

a plurality of holding devices on the frame adjacent the open area, each holding device having a rod with an end surface, the rod being moveable in reciprocating movements along an axis of the rod between an extended position of the rod where the rod end surface is moved into the open area to engage with a shaft positioned in the open area and to support the shaft on the rod end surface, and a retracted position of the rod where the rod end surface is moved out of the open area;

a plurality of actuator devices on the frame on an opposite side of the open area from the plurality of holding devices, each actuator device having a ram with an end surface, the ram being moveable in reciprocating movements along an axis of the ram between an extended position of the ram where the ram end surface is moved into the open area to engage with a shaft that is supported in the open area by rod end surfaces and to bend the shaft and move the shaft a distance through the open area, and a retracted position of the ram where the ram end surface is moved out of engagement with the shaft and out of the open area; and, a plurality of proximity sensors on the frame adjacent the open area, each proximity sensor being operable to sense the distance the shaft is moved through the open area by one of the plurality of actuator device ram end surfaces that is moved into the open area and engages with and bends the shaft.

11. The apparatus of claim 10, further comprising:

the plurality of proximity sensors being positioned on the frame with each proximity sensor being adjacent an actuator device of the plurality of actuator devices.

12. The apparatus of claim 10, further comprising:

a rotation device on the frame adjacent the open area, the rotation device being connectable to a shaft positioned in the open area and the rotation device being operable to rotate the shaft in the open area.

13. The apparatus of claim 10, further comprising:

the plurality of holding devices being positioned side by side in a same plane; and, the plurality of actuator devices being positioned side by side in a same plane.

14. The apparatus of claim 10, further comprising:

each rod axis being coaxial with a ram axis.

15. The apparatus of claim 10, further comprising:

the rod axes of the plurality of holding device rods being parallel and coplanar.

16. The apparatus of claim 10, further comprising:

the ram axes of the plurality of actuator device rams being parallel and coplanar.

17. The apparatus claim 10, further comprising:

a controller being operable to communicate with the plurality of proximity sensors to receive the signal output by each proximity sensor; and, a display screen communicatively coupled to the controller, the display screen being operable to display a visual indication of the distances sensed by the plurality of proximity sensors.

18. A shaft straightening apparatus comprising:

a frame;

a plurality of holding devices on the frame, each holding device having a rod with an end surface, the rod being moveable in reciprocating movements along an axis of the rod between an extended position of the rod where the rod end surface is positioned to support a shaft on the rod end surface, and a retracted position of the rod;

a plurality of actuator devices on the frame, each actuator device having a ram with an end surface that opposes a rod end surface, the ram being moveable in reciprocating movements along an axis of the ram between an extended position of the ram where the ram end surface is moved to engage with a shaft that is supported by rod end surfaces and to bend the shaft and move the shaft a distance; and a retracted position of the ram where the ram end surface is moved out of engagement with the shaft; and, a rotation device on the frame, the rotation device being connectable to the shaft supported on the rod end surfaces and the rotation device being operable to rotate the shaft.

19. A method of straightening a shaft comprising:

positioning the shaft in an open area of a frame, the open area having been dimensioned to receive the shaft;

extending a first rod from a first holding device that is positioned on the frame adjacent the frame open area, the first rod being extendible from the first holding device and retractable to the first holding device;

extending the first rod into the frame open area until the first rod engages against the shaft in the frame open area;

supporting the shaft in the frame open area on the first rod that has been extended into the frame open area and into engagement with the shaft;

extending a second rod from a second holding device that is positioned on the frame adjacent the frame open area, the second rod being extendible from the second holding device and retractable to the second holding device;

extending the second rod into the frame open area until the second rod engages against the shaft in the frame open area;

supporting the shaft in the frame open area on the second rod that has been extended into the frame open area and into engagement with the shaft;

operating a proximity sensor that is positioned on the frame adjacent the frame open area;

operating the proximity sensor to sense a distance from the proximity sensor to the shaft supported on the first rod and the second rod that have been extended into the frame open area and outputting a signal from the proximity sensor that is indicative of the sensed distance;

extending a ram from an actuator device that is positioned on the frame at an opposite side of the frame open area from the first holding device and the second holding device, the ram being extendible from the actuator device and retractable to the actuator device;

extending the ram from the actuator device into the frame open area until the ram engages against the shaft between the first rod and the second rod supporting the shaft the frame open area;

continuing to extend the ram into the frame open area and bending the shaft and moving the shaft a distance through the frame open area by continuing to extend the ram; and, operating the proximity sensor to sense a distance the shaft is moved through the frame open area by the extended ram.

* * * * *